United States Patent [19]

Parker et al.

[11] 4,054,550

[45] Oct. 18, 1977

[54] PROCESS FOR PRODUCING CIGARETTE FILTERS

[75] Inventors: Frederick John Parker, Newport; Durgacharan Sen, Cwmbran, both of Wales

[73] Assignee: Monsanto Limited, London, England

[21] Appl. No.: 566,508

[22] Filed: Apr. 9, 1975

[30] Foreign Application Priority Data

Apr. 11, 1974 United Kingdom ..... 16198/74

[51] Int. Cl.[2] ..... B29D 27/00

[52] U.S. Cl. ..... 264/45.3; 131/10 R; 131/269; 260/2.5 E; 264/45.5; 264/53; 264/151; 264/210 R; 264/DIG. 5; 264/DIG. 13; 264/DIG. 14; 264/DIG. 16; 264/DIG. 17

[58] Field of Search ..... 264/53, 54, DIG. 13, 264/DIG. 16, 45.3, 45.5, 151, 210 R, DIG. 5, DIG. 17, DIG. 14; 131/10 R, 269; 260/2.5 E

[56] References Cited

U.S. PATENT DOCUMENTS

| | | | |
|---|---|---|---|
| 3,188,295 | 6/1965 | Ballast et al. | 264/DIG. 16 |
| 3,281,513 | 10/1966 | Stripp et al. | 264/54 X |
| 3,303,045 | 2/1967 | Newman | 264/53 X |
| 3,310,617 | 3/1967 | Dygert et al. | 264/53 |
| 3,358,695 | 12/1967 | Blakey et al. | 264/DIG. 13 |
| 3,440,309 | 4/1969 | Breukink et al. | 264/53 |
| 3,610,509 | 10/1971 | Winstead | 264/DIG. 13 |
| 3,755,208 | 8/1973 | Ehrenfreund | 264/DIG. 13 |
| 3,785,919 | 1/1974 | Hickman | 264/DIG. 13 |
| 3,861,404 | 1/1975 | Changani | 131/269 |
| 3,863,000 | 1/1975 | Kasai et al. | 264/DIG. 13 |
| 3,922,328 | 11/1975 | Johnson | 264/54 X |
| 3,939,237 | 2/1976 | Naito et al. | 264/54 |
| 3,939,849 | 2/1976 | Baxter et al. | 131/10 R X |

FOREIGN PATENT DOCUMENTS

| | | | |
|---|---|---|---|
| 1,182,646 | 2/1970 | United Kingdom | 264/DIG. 13 |
| 1,221,488 | 2/1971 | United Kingdom | 264/53 |
| 1,341,400 | 12/1973 | United Kingdom | 264/DIG. 13 |
| 908,185 | 10/1962 | United Kingdom | 264/DIG. 13 |
| 1,271,274 | 4/1972 | United Kingdom | 264/54 |
| 1,218,438 | 1/1971 | United Kingdom | 264/53 |

*Primary Examiner*—Philip Anderson
*Attorney, Agent, or Firm*—Russell E. Weinkauf

[57] ABSTRACT

An improved process is provided for producing cigarette filters comprised of a substantially open-cell foamed thermoplastic polypropylene resin wherein a mixture comprising a thermoplastic polypropylene resin, a volatile blowing agent and a nucleating agent is extruded through a die to produce a strand of foamed resin with the strand then being cut into individual filter elements. The improvement comprises employing as a primary nucleating agent from 0.1 to 40 percent by weight, based on the weight of the resin, of a particulate compound of a metal selected from Groups IIA, IIIA or IVA of the Mendeleef periodic table of elements together with from 0.01 to 5.0 percent by weight, based on the weight of the primary nucleating agent, of a synergist consisting of an organic compound having a hydrophobic group and a hydrophilic group. A particularly effective combination is the use of calcium carbonate as the primary nucleating agent and potassium benzoate as the synergist compound.

8 Claims, 1 Drawing Figure

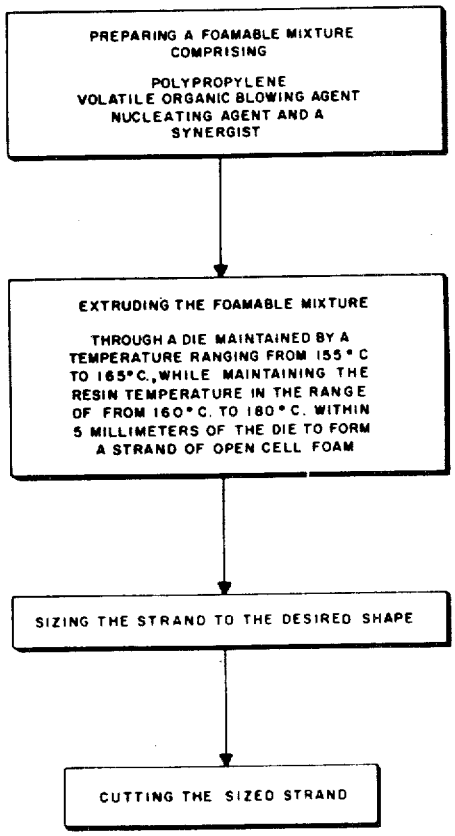

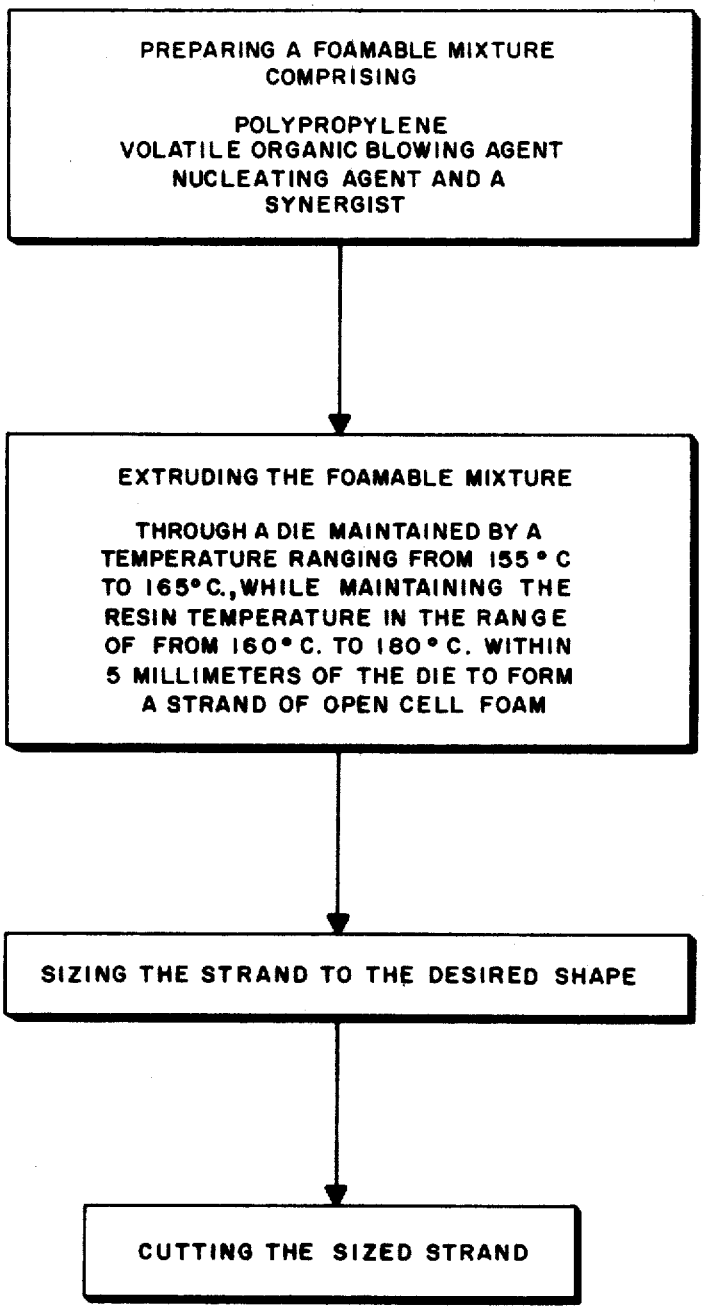
PREPARING A FOAMABLE MIXTURE COMPRISING
POLYPROPYLENE
VOLATILE ORGANIC BLOWING AGENT
NUCLEATING AGENT AND A SYNERGIST
EXTRUDING THE FOAMABLE MIXTURE
THROUGH A DIE MAINTAINED BY A TEMPERATURE RANGING FROM 155 °C TO 165°C., WHILE MAINTAINING THE RESIN TEMPERATURE IN THE RANGE OF FROM 160° C. TO 180° C. WITHIN 5 MILLIMETERS OF THE DIE TO FORM A STRAND OF OPEN CELL FOAM
SIZING THE STRAND TO THE DESIRED SHAPE
CUTTING THE SIZED STRAND

PROCESS FOR PRODUCING CIGARETTE FILTERS

This invention relates to cigarette filters.

It has been proposed to produce cigarette filters by extruding a strand of open-cell foamed plastics material and cutting the strand into individual filter elements. One such proposal is found in U.S. Pat. No. 3,939,849 to Baxter, et al. incorporated herein by way of reference which describes particularly efficient foamed thermoplastic highdensity polyethylene or thermoplastic polypropylene filters having a low resistance to flow of smoke and other desirable properties, by virtue of a certain special micro-structure.

We have found that of these filters the polypropylene ones possess a particularly good degree of resilience after compression. For example, after compression for 15 seconds to 50% of their uncompressed diameter, examples of polypropylene filters have been found to recover 95% or even 98% of the amount by which they were compressed. However, we have also found that it is not always easy to control the properties of the polypropylene resin filters to the same extent that is possible with high-density polyethylene resin filters. A range of polypropylene filters falling within the defined scope of U.S. Pat. 3,939,849 can certainly be made, but it would be desirable to be able to achieve a finer control of their properties.

The filter properties depend on the foam's microstructure, which is produced as the resin is extruded and is accordingly determined by the conditions of the extrusion process. One of these conditions is the presence or absence of a nucleating agent, which as explained in U.S. Pat. 3,939,849 assists in the formation of fine cells. There has now been found a nucleating agent that not only acts in the way mentioned above but can be used, by varying its composition, to control the properties of the final polypropylene cigarette filter.

The cigarette filter of the invention is one comprising an extruded element of a substantially open-cell foamed thermoplastic polypropylene resin, the extruded element having a cross-section corresponding to that to the relevant cigarette, a substantially uniform cell size and a micro-structure such that the filter has a hardness greater than 80%, a resilience greater than 80%, a $\Delta P_{10}$ from 2.5 to 15 centimetres water-gauge and a $TPM_{10}$ filtration efficiency greater than 12%, and having been produced by a process in which a mixture comprising the resin, a volatile blowing agent and a nucleating agent is extruded through a die to produce a strand of foamed resin of the said cross-section that is cut into individual filter elements, the nucleating agent comprising as primary nucleating agent from 0.1 to 40% by weight, based on the weight of resin, of a particulate compound of a metal of Group IIa, IIIa or IVa of the Mendeleef periodic table of elements and as synergist from 0.01 to 5% by weight, based on the weight of primary nucleating agent, of an organic compound having a hydrophobic group and a hydrophilic group.

The process of the invention is one of producing extruded elements as defined above, which comprises extruding a mixture comprising a thermoplastic polypropylene resin, a volatile blowing agent and a nucleating agent through a die to produce a strand of foamed resin and cutting the strand into individual filter elements, the nucleating agent comprising as primary nucleating agent from 0.1 to 40% by weight, based on the weight of resin, of a particulate compound of a metal of Group IIA IIIA or IVA of the Mendeleef periodic table of elements and as synergist from 0.01 to 5% by weight, based on the weight of primary nucleating agent, of an organic compound having a hydrophobic group and a hydrophilic group.

By the hardness of a cigarette filter is meant its hardness as measured by means of a Filtrona Tester (manufactured by Cigarette Components Limited; "Filtrona" is a registered Trade Mark), by a test in which a rod (for example a length of say 120 millimeters) of the foamed resin having a mean diameter (D), for example about 7.8 millimetres, is compressed between two plates provided in the instrument. The rod is subjected to compression for 15 seconds by a load of 300 grams applied to opposite sides of the cylindrical surface of the rod and the average depression (A), that is, the decrease in diameter of the rod, is measured. The hardness is the diameter of the sample measured at a load of 300 grams and expressed as a percentage of the original diameter, that is, it is given by the following formula:

$$\text{Hardness} = [(D-A)D] \times 100\%.$$

Resilience is measured by compressing a similar sample transversely to 50% of its original diameter, releasing the compression after 15 seconds and noting the percentage of the compression that is regained.

By $\Delta P_{10}$ is meant the pressure drop of a filter, and this is measured by the following method. Air is pumped through a 10-millimeter length of the filter at a steady rate of 1050 cubic centimetres per minute as indicated on a Rotameter (registered Trade Mark) gauge, and the resulting pressure difference across the filter is measured by means of a water manometer. The result is expressed in centimeters of water gauge.

The $TPM_{10}$ filtration efficiency is a measure of the effectiveness with which the filter absorbs tar particulate matter, and is measured according to the following method. Filter tips of length 10 mm. are attached to cigarettes. These are smoked using a multiport smoking machine which takes one puff of 35 cc. of air over a period of 2 seconds every minute through each cigarette, the cigarettes being extinguished when 8 mm. of tobacco rod remains. The smoke is collected on a glass fibre pad held in a holder, the complete unit of pad and holder being commonly known as a Cambridge filter and such that the glass fibre pad retains all tar particulate matter from smoke passing through it. The smoke from five cigarettes is collected on each Cambridge filter, and a total of ten cigarettes is smoked, the Cambridge filters being weighed before and after smoke collection to obtain a measurement of the weight of tar particulate matter collected. The tar particulate matter is similarly collected and weighed from the same number of cigarettes that are identical except that they are not fitted with the filter tips. The $TPM_{10}$ filtration efficiency is calculated from the formula:

$$[(S_1 - S_2)/S_1] \times 100\%$$

where $S_1$ is the delivery of tar particulate matter (mg/cigarette) for the plain cigarettes and $S_2$ is the delivery of tar particulate matter for the cigarettes having the filters.

In the instance of $\Delta P_{10}$ and $TPM_{10}$ as defined above the values will of course be appropriately different where there is in question a filter length of less or greater than 10 millimeters.

Percentage hardness, $\Delta P_{10}$ and $TPM_{10}$ filtration efficiency are thus used herein as defined in U.S. Pat. 3,939,849, except that $TPM_{10}$ filtration efficiency is measured on a sample 10 millimeters long instead of 15 millimeters. A $TPM_{10}$ of 12% is approximately equivalent to a $TPM_{15}$ of 20%.

The invention also comprises an extruded foamed rod of substantially open-cell thermoplastic polypropylene resin produced by an extrusion process as defined above and having a cross-section and other properties such that it can be cut up into extruded filter elements as defined above. By "rod" is meant the extruded foam in a length which can conveniently be handled and cut into shorter filter lengths in a further operation. Normally a rod has a length that is a simple multiple between 2 and 10 times the length of an individual filter, and it can therefore for example be in the range of 90 to 120 or 150 millimeters.

Also part of the invention is a cigarette that contains a cigarette filter according to the invention.

Preferably the extruded element of foamed resin has a majority of cell walls that contain perforations and the microstructure of the foamed resin comprises fibre elements that bridge the perforations in the cell walls. This is fully described in U.S. Pat. No. 3,939,849 to which reference is made.

The cell size is substantially uniform. For example, the presence of very large cells at the centre of the extruded element, for example of diameter more than five times the average cell diameter, is undesirable since they can give rise to a channel for the smoke that bypasses the smaller cells nearer the periphery of the element. However, there is often a gradation of cell diameter along a radius of the element, and the presence of a number of very fine cells immediately adjacent to the periphery is permitted. Often, the number of cells counted along a diameter of a thin transverse section of an extruded element is from 15 to 40. From 20 to 30 is often a good number of cells counted in this way.

The polypropylene preferably has a melt index of from 1 to 12 grams per 10 minutes, for example from 2 to 10 and especially from 2 to 8 grams per 10 minutes as measured at a temperature of weight of 2.16 kilograms (ASTM Test No. D-1238).

The primary nucleating agent is in particulate form and it is desirable that this form should not be destroyed, for instance by melting or dissolution during the extrusion. Thus, because of their high melting point, inorganic compounds are preferred as primary nucleating agent, particularly oxides, hydroxides, silicates, carbonates or sulphates as appropriate, depending on the physical and biological properties required in the primary nucleating agent. Thus, for example, calcium carbonate, which can for instance be in the form of chalk, calcite or limestone, is the preferred primary nucleating agent, while other suitable examples include calcium silicate, magnesium oxide, magnesium carbonate, dolomitic limestone, talc, alumina, titanium dioxide, barium sulphate. Radium compounds are most unlikely to be suitable because of their high price and radioactivity, neither for example are the barium compounds suitable (because of their toxicity) other than the very highly insoluble compounds such as the sulphate. Although compounds of the rare earth metals are normally expensive, they can be used if desired. Titanium dioxide is another suitable primary nucleating agent. An example of an organic primary nucleating agent is calcium acetate. A mixture of two or more primary nucleating agents can be used.

The particles of the primary nucleating agent are preferably substantially uniform in size. Preferably most of the particles are substantially spherical and between 0.5 and 25 microns in diameter, diameters of between 2 and 10 microns being more preferred. Where the particles do not have a substantially spherical shape, the above figures refer to their major particle dimension.

The amount of primary nucleating agent can be quite large, so that in effect it acts also as a filler. On the other hand, a worthwhile nucleating effect can be observed using comparatively small quantities of primary nucleating agent. An amount or primary nucleating agent between 0.1 and 20% by weight, based on the weight of resin, is often sufficient, preferably from 1 to 15%, for example from 5 to 12%. Examples of large amounts, where the nucleating agent acts as a filler as mentioned above, are 10 to 40% by weight, based on the weight of resin.

The synergist is an organic compound having inter alia a hydrophobic group, a wide choice of hydrophobic groups being available. The most preferred type of hydrophobic group is a hydrocarbon group, which can for example be an aromatic hydrophobic group, for example a phenyl, benzyl, naphthyl or bisphenyl group. Alternatively a paraffinic or olefinic group of 4 to 30 carbon atoms, and more preferably from 10 to 20 atoms, can be employed. One or more hydrogen atoms of the hydrophobic group can be replaced by a substituent group such as hydroxyl or halogen, preferably chlorine or bromine, if desired.

The hydrophilic group of the synergist is preferably ionic and preferably also compact, in that it permits adsorption of molecules of the synergist on the surface of the primary nucleating agent with the hydrophobic groups projecting out from the surface and a relatively small distance, for example 15 Angstrom units or less, between adjacent synergist molecules. It has been found that benzoic acid and its salts of metals such as lithium, sodium, potassium, calcium or magnesium make excellent synergists. Substituted benzoic acids and their salts, for example salicyclic acid or a halobenzoic acid and the salts of these are also useful. Monoesters of simple dihydric and trihydric alcohols, e.g. glyceryl monobenzoate or monostearate are also good, and so is sorbitan tristearate, but monoesters of long chain polyethylene glycols have been found not to be so useful. It is believed that in the latter case the long (and thus not compact) polyethyleneoxy chain is adsorbed on to the surface of the primary nucleating agent at several points all along the chain, covering the surface and discouraging further adsorption. On the other hand, a synergist such as benzoic acid of sodium or potassium benzoate has only one hydrophylic group, and this is both compact and terminal, so that several synergist molecules can thus be accommodated in greater density on the primary nucleating agent's surface.

Other examples of suitable synergists include the lithium, sodium, potassium, calcium and magnesium salts of fatty acids, for instance those of lauric, myristic, stearic, palmitic, and oleic acids. Some ester synergists are referred to above, and another example is sorbitan oleate.

The amount of synergist required is usually very small. An important feature of the invention is the way that the properties of the filters can be controlled by varying the amount of the synergist employed. Thus, for example, both $TPM_{10}$ and pressure drop can be increased by increasing the proportion of the synergist in the nucleating agent. This effect has not been observed with high-density polyethylene resin. An amount from 0.01 to 5% by weight based on the weight of primary nucleating agent is sufficient, and preferably from 0.1 to 0.5% is used. Expressed as a proportion by weight based on the combined weight of resin, and nucleating agent, there is usually employed from 0.0005% to 1.0%, more preferably from 0.001 to 0.1% by weight.

The components of the nucleating agent are preferably mixed with one another before being blended with the resin, since in this way there is achieved a good measure of intimate mixing between the components and hence a greater nucleation efficiency. It is believed that the explanation of this greater efficiency lies in an adsorption effect as described above, the hydrophobic surface thus produced on the particles of primary nucleating agent enhancing the nucleation effect and altering the course of the foaming. Normally no special precautions are necessary in this mixture process apart from any that might be imposed by the known chemical or physical properties of the components being mixed.

The nucleating agent can be blended with the resin by any convenient conventional method, although extrusion blending is preferred.

The process for producing the filter can be carried out as generally described in U.S. Pat. No. 3,939,849 and that description, for instance of the blowing agent and the amount employed, die design, sizing and haul-off equipment and so on, is therefore not repeated here. However, a greater latitude in the temperatures is permissible, for example a melt temperature of from 155° to 180° C. and a die temperature of from 150° to 180° C. may be employed. These temperatures are measured as described in U.S. Pat. 3,939,849. Thus the melt temperature is the temperature of the mixture of resin and blowing agent behind the die entrance, and needs to be measured with a totally immersed fine thermocouple that is substantially unaffected by heat flows to or from its immediate environment, as explained in detail in that specification. Similarly, full details are given therein of the measurement of die temperature, which is the metal temperature within 5 millimeters of the resin metal interface. Preferred melt and die temperatures are from 157° to 175° C. and from 152° to 165° C. respectively.

The hardness of a cigarette filter of the invention as measured in the way described above is preferably greater than 75%. Preferably it is more than 80%, and for many applications and particularly where the whole of the filter consists of a foamed element of the invention a hardness range of from about 90% to 99% includes the majority of the most desirable filters. Even a figure of 100% could be approached in favourable circumstances.

Preferably the resilience of the filter is 90% to 100%, for example 95% to 98%.

The pressure drop across the cigarette filter ($\Delta P_{10}$) is preferably less than 15 centimeters water gauge. A particularly acceptable pressure drop is one below 7 centimeters and sometimes considerably below, such as down to 0.5 centimeter; the pressure drop can be for example from 1 to 6 centimeters and particularly between 2 and 5 centimeters of water gauge.

In general the $TPM_{10}$ filtration efficiency of a cigarette filter according to the invention is greater than 12% but it is preferably greater than 18% and can for example be in the range of from 20 to 50% or more.

For a filter consisting wholly of the extruded element a $TPM_{10}$ in the vicinity of 30 or 45% is often very suitable, but where a composite cigarette filter is to be used, only part of which consists of the extruded element and the remainder being for example paper wadding or cellulose acetate tow, the element can in many instances usefully have a TPM greater than 45% and perhaps up to 60% or 80% or even higher.

The drawing is a diagram noting the steps and conditions for making cigarette filters according to this invention.

Other features of the filters of the invention, for example the cross-section and density, are as described in U.S. Pat. No. 3,939,849.

The invention is illustrated by the following Example. All parts and proportions are by weight except where otherwise stated.

EXAMPLE

This Example describes cigarette filters according to the invention, and their production by a process according to the invention. A number of runs are described to demonstrate the control of filter properties that can be effected.

Polypropylene of crystalline melting point about 170° C. and melt index 4.5 grams per 10 minutes (at 230° C. under a 2.16 kg. weight) was blended with 12% of crushed limestone of average particle diameter 5 microns, based on the combined weight of limestone and polypropylene. The limestone had been mixed with various quantities of potassium benzoate, as noted in the table below, in a number of runs. The mixture was fed to a 3.81 cm. diameter screw extruder equipped with a two-stage screw, a nozzle for injecting isobutylene under pressure into the extruder barrel, and a circular orifice die of diameter 1.6 mm. and land 3.2 mm. The table shows the throughput, the rate of addition of isobutylene (blowing agent), and the temperatures of the die and of the melt behind the die both measured as described in U.S. Pat. No. 3,939,849. These conditions gave stable extrusion to an open-cell foamed polypropylene rod having a smooth exterior skin. After passing through air for 20 centimeters, the rod was pulled into a cylindrical brass tube of internal diameter 0.815 cm. and length 5 cm., and thence into a second cylindrical brass tube of internal diameter 0.875 cm. and length 5 cm. The second tube was set in the end wall of a water trough of length 3 meters so that it was thereby cooled, the water temperature being 20° C. The rod passed along the trough and at the end passed through two more cylindrical tubes of length 5 cm. and internal diameter 0.875 cm., to act as a water seal. After passing through a haul-off garniture it was cut into 90 mm. lengths.

It was found that all the lengths were of circular cross-section and had a circumference as shown in the table. They could each be cut into six 15 mm. long filter tips, which when tested had a hardness, $\Delta P_{10}$ water-gauge and $TPM_{10}$ filtration efficiency also shown in the table. On microscopic examination with a deep-focus microscope they had a complex open structure with many fibre elements bridging large single openings that took up most of the cell wall area of the foam.

| Run No. | 1 | 2 | 3 | 4 |
|---|---|---|---|---|
| *% potassium Benzoate | 0.0 | 0.05 | 0.1 | 0.2 |

-continued

| Run No. | 1 | 2 | 3 | 4 |
|---|---|---|---|---|
| Moles of Isobutylene[a] | 0.076 | 0.076 | 0.079 | 0.091 |
| Throughput (g/min) | 53.0 | 52.0 | 51.0 | 52.0 |
| Melt temp. ° C. | 159.4 | 159.0 | 163.0 | 167.4 |
| Die temp. ° C. | 154.4 | 163.7 | 152.8 | 153.8 |
| Product Circumference (mm.) | 24.6 | 25.0 | 25.1 | 24.3 |
| Hardness % | 93 | 93 | 92 | 92 |
| $\Delta P_{10}$ (cms $H_2O$) | 1.8 | 3.6 | 3.9 | 9.7 |
| $TPM_{10}$ % | 17.9 | 20.9 | 35.8 | 55.0 |

*Based on weight of limestone.

[a]Per 100 grams of extrudate, after blowing agent and any other volatile constituents had diffused into the atmosphere.

All the filters had a resilience greater than 95%. They had a uniform fine cell size with no gross defects.

It can be seen that variation in the proportion of potassium benzoate allows control of the properties of the resulting filter, and that with no potassium benzoate the $TPM_{10}$ filtration efficiency and $\Delta P_{10}$ are rather low. Whilst the latter filter is useful in some instances, usually higher $\Delta P_{10}$ and efficiency are desired. It was not found possible to adjust the extrusion conditions so as to increase $\Delta P_{10}$ or $TPM_{10}$ filtration efficiency very much above these levels for the nucleating agent containing no potassium benzoate. However, as the above results show, addition of potassium benzoate does shift the filter towards higher $\Delta P_{10}$ and $TPM_{10}$ filtration efficiency.

We claim:

1. In a process wherein a cigarette filter element comprised of a substantially open-cell foamed thermoplastic polypropylene resin is produced by the following steps taken in sequence:

a. providing a foamable mixture comprised of a thermoplastic polypropylene resin, a volatile blowing agent and a nucleating agent;

b. extruding said mixture through a die under controlled temperature conditions to produce a strand of foamed polypropylene resin wherein the melt temperature of the resin is maintained in the range of from 160° to 180° C and the temperature within 5 millimeters of the die is maintained in the range of from 155° to 165° C;

c. passing said strand of foamed resin through sizing means to effect a cross-sectional diameter corresponding to that of a cigarette; and d. cutting the sized strand into individual filter elements; the improvement which comprises:

i. employing a primary nucleating agent together with a synergist therefor in said foamable mixture, said primary nucleating agent being a particulate compound of a metal selected from Groups IIA, IIIA or IVA of the Mendeleef periodic table of elements and having a particle size in the range of from about 0.5 to 25 microns, and wherein said synergist is an organic compound having a hydrophilic group and a hydrophobic group wherein the hydrophilic group is ionic and the hydrophobic group is a hydrocarbon or a hydrocarbon having one or more hydrogen atoms substituted by a hydroxyl or halogen, said primary nucleating agent being present in said foamable mixture in an amount of from about 0.1 to 40 percent by weight, based on the weight of said polypropylene resin, and said synergist being present in an amount of from about 0.01 to 5.0 percent by weight, based on the weight of said primary nucleating agent; and ii. controlling the temperature of said extrusion such that the melt temperature of said polypropylene resin is maintained in the range of from about 155° to 180° C and the temperature within 5 millimeters of the die is maintained in the range of from about 150° to 180° C.

2. The process in accordance with claim 1 wherein said primary nucleating agent is an inorganic compound.

3. The process in accordance with claim 1 wherein said primary nucleating agent is calcium carbonate.

4. The process in accordance with claim 1 in which the synergist is benzoic acid or a salt thereof.

5. The process in accordance with claim 1 in which the synergist is potassium benzoate.

6. In a process wherein a cigarette element comprised of a substantially open-cell foamed thermoplastic polypropylene resin is produced by the following steps taken in sequence:

a. providing a foamable mixture comprised of a thermoplastic polypropylene resin, a volatile blowing agent and a nucleating agent;

b. extruding said mixture through a die under controlled temperature conditions to produce a strand of foamed polypropylene resin wherein the melt temperature of the resin is maintained in the range of from 160° to 180° C and the temperature within 5 millimeters of the die is maintained in the range of from 155° to 165° C;

c. passing said strand of foamed resin through sizing means to effect a cross-sectional diameter corresponding to that of a cigarette; and d. cutting the sized strand into individual filter elements;

the improvement which comprises:

i. employing a primary nucleating agent in conjunction with a synergist therefor in said foamable mixture, said primary nucleating agent consisting of from about 0.1 to 40 percent by weight, based on the weight of said polypropylene resin, of calcium carbonate in particulate form with the particle size being in the range of from about 0.5 to 25 microns, and wherein said synergist consists of from about 0.01 to 5.0 percent by weight of potassium benzoate based on the weight of said primary nucleating agent;

ii. controlling the temperature of said extrusion such that the melt temperature of said polypropylene resin is maintained in the range of from about 155° to 180° C and the temperature within 5 millimeters of the die is maintained in the range of from about 150° to 180° C.

7. The process in accordance with claim 6 wherein said primary nucleating agent is employed in an amount of from about 1 to 15 percent by weight based on the weight of said thermoplastic polypropylene resin.

8. The process in accordance with claim 6 wherein said synergist is employed in an amount of from about 0.1 to 0.5 percent by weight based on the weight of said primary nucleating agent.

* * * * *